United States Patent [19]

Gillis

[11] 4,329,082

[45] May 11, 1982

[54] SHIPLIFT APPARATUS

[76] Inventor: Michael E. Gillis, P.O. Box 22386, Fort Lauderdale, Fla. 33335

[21] Appl. No.: 152,343

[22] Filed: May 22, 1980

[51] Int. Cl.[3] ..... B63C 3/06

[52] U.S. Cl. ..... 405/3; 114/48

[58] Field of Search ..... 405/3; 114/48, 51

[56] References Cited

U.S. PATENT DOCUMENTS

| | | | |
|---|---|---|---|
| 481,411 | 8/1892 | Moran | 405/3 |
| 3,073,125 | 1/1963 | Pearlson | 405/3 |
| 3,504,502 | 4/1970 | Blount | 405/3 |
| 3,777,691 | 12/1973 | Beale | 114/48 |
| 4,087,979 | 5/1978 | Pearson | 405/3 |

*Primary Examiner*—Ernest R. Purser

*Attorney, Agent, or Firm*—Oltman and Flynn

[57] ABSTRACT

The present shiplift apparatus has a horizontal lift platform with eight lift points (four on each side along the length of the platform). Four lift motors are provided, each operating a first cable for lifting the platform at a lift point which is located toward the longitudinal, midpoint of the platform and a second cable for lifting the platform at a lift point near one end or the other of the platform. Each second cable is connected to a linear actuator for leveling up the platform independent of the lift motors.

19 Claims, 10 Drawing Figures

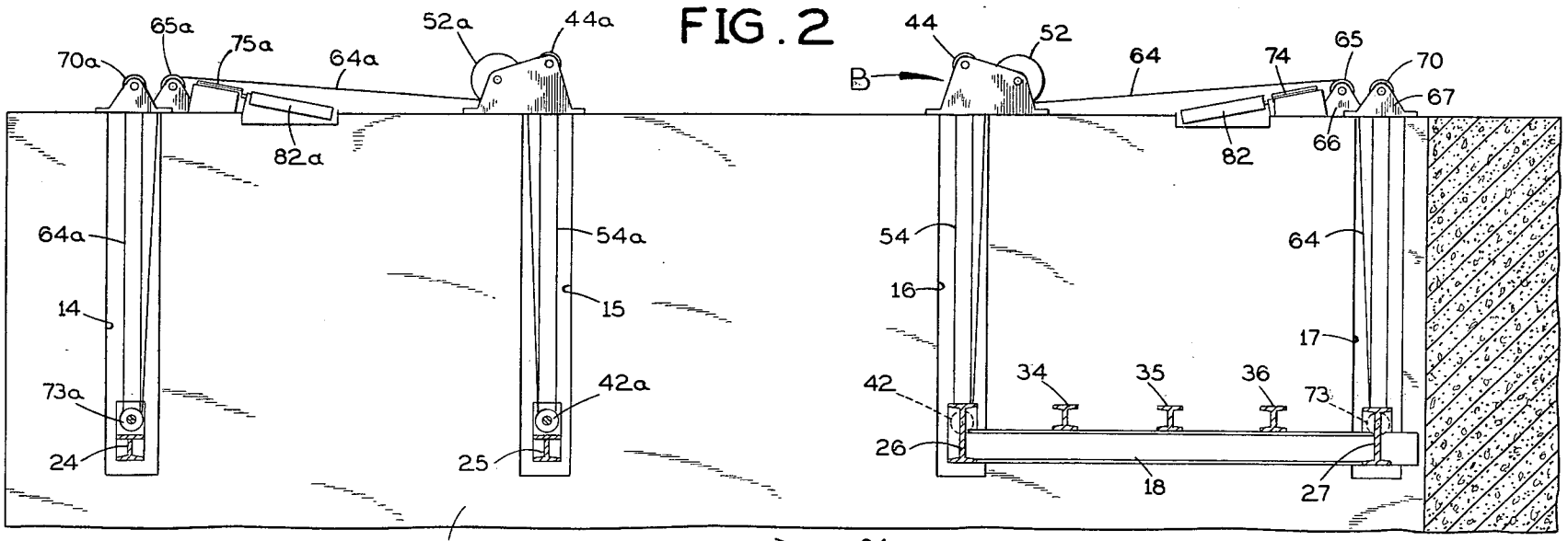
FIG. 2
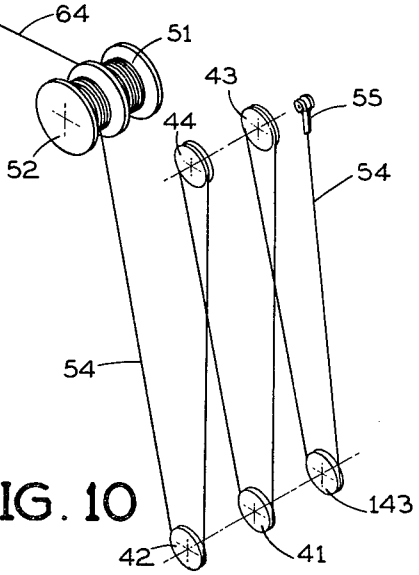
FIG. 10
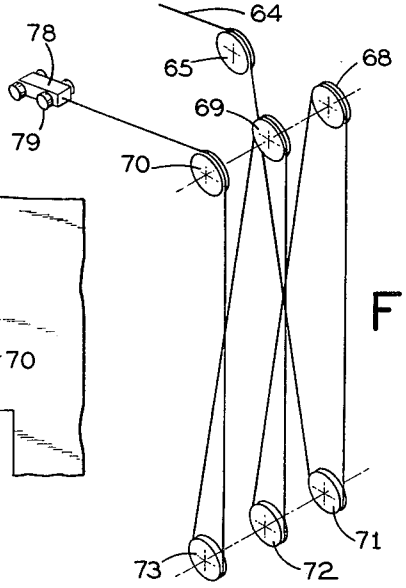
FIG. 9
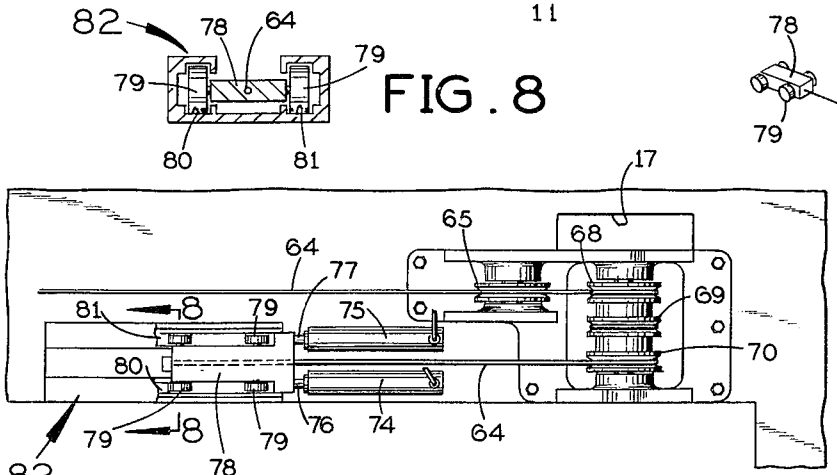
FIG. 7
FIG. 8

SHIPLIFT APPARATUS

SUMMARY OF INVENTION

This invention relates to an apparatus for lifting or lowering a water-borne structure, such as a ship or boat going into or leaving dry dock in a shipyard or a caisson that is to be towed by water to a construction site in a harbor.

U.S. Pat. Nos. 3,073,125 and 4,087,979 disclose shiplift systems which are particularly well suited for use in raising large water vessels having heavy ton-per-foot loadings along the length of the keel. They use sectional platforms which are raised and lowered by a large number of relatively closely spaced, heavy duty, motor-driven winches connected to lift points at the opposite ends of transverse horizontal beams in each platform section. Also U.S. Pat. No. 3,504,502 discloses another type of cable shiplift having winches with multiple drums.

However, such systems are not especially adapted for use with smaller vessels. If as few as four winches or drums are used (one for each of four lift points on the platform), the breaking of just one winch-operated wire rope cable in the system can be extremely dangerous. The addition of another pair of lift points on the platform (making a total of six) has not proven practical because of excessive loading on the middle transverse beam in the platform. The deficiencies in the four-winch and six-winch lifting systems for smaller vessels suggest the desirability of a system having eight lift points, located at the opposite ends of four transverse beams in the lift platform. However, an eight lift point system with eight winches would not be practical economically.

In other types of shiplifts designed for smaller vessels, the lift platform is required to be fabricated at the site because the platform ordinarily is a rigid unitary structure with relatively long longitudinal beams as a result of the wide distance between the winches. Welding in the field involves additional costs and often creates quality control problems which may compromise the integrity of the entire installation.

Another problem associated with previous shiplifts has been the final leveling-up of the lift platform to the desired elevation to facilitate transferring the vessel ashore. Such leveling-up often is necessary because of stretching which takes place in the winch-operated wire rope cables. Usually, the winch motors are "jogged" (i.e., momentarily cycled), which requires rapid release and reapplication of the motor brakes while the motors are under heavy load. In some instances, slippage of the motor brakes or insufficient torque of the motors being jogged has caused the platform end to drop back down or to stall before reaching the desired elevation.

The present invention relates to a novel apparatus which is particularly adapted for lifting small water vessels and has a novel arrangement for effecting the final leveling-up of the lift platform.

A principal object of this invention is to provide a novel lifting apparatus which is practical, safe and economical for dry docking relatively small water vessels, such as yachts, fishing boats and ships engaged in coastal operations.

Another object of this invention is to provide such a lifting apparatus having a novel arrangement for carrying out the final leveling-up of the lift platform.

Another object of this invention is to provide a novel four-winch shiplift system which has eight lift points and therefore is not as vulnerable to the breaking of a single winch-operated wire rope cable in the system.

Still another object is to provide a sheave system which is fail-safe.

Another object of this invention is to provide a novel four-winch shiplift system with a lift platform that can be prefabricated without the need for on-site welding of its structural members.

Other objects of this invention will appear from the following description and appended claims, reference being had to the accompanying drawings forming a part of this specification wherein like reference characters designate corresponding parts in the several views.

DESCRIPTION OF THE DRAWINGS

FIG. 2 is a vertical longitudinal section taken along the line 2—2 in FIG. 1;

FIG. 7 is a fragmentary top plan view, with certain parts broken away for clarity, of that part of the apparatus which appears in FIGS. 3 and 5;

FIG. 8 is a fragmentary vertical cross-section taken along the line 8—8 in FIG. 7;

FIG. 9 is a schematic perspective view of that part of the apparatus which is shown in FIGS. 3, 5 and 7; and FIG. 10 is a schematic perspective view of that part of the apparatus which is shown in FIGS. 4 and 6.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION

Figure 1:
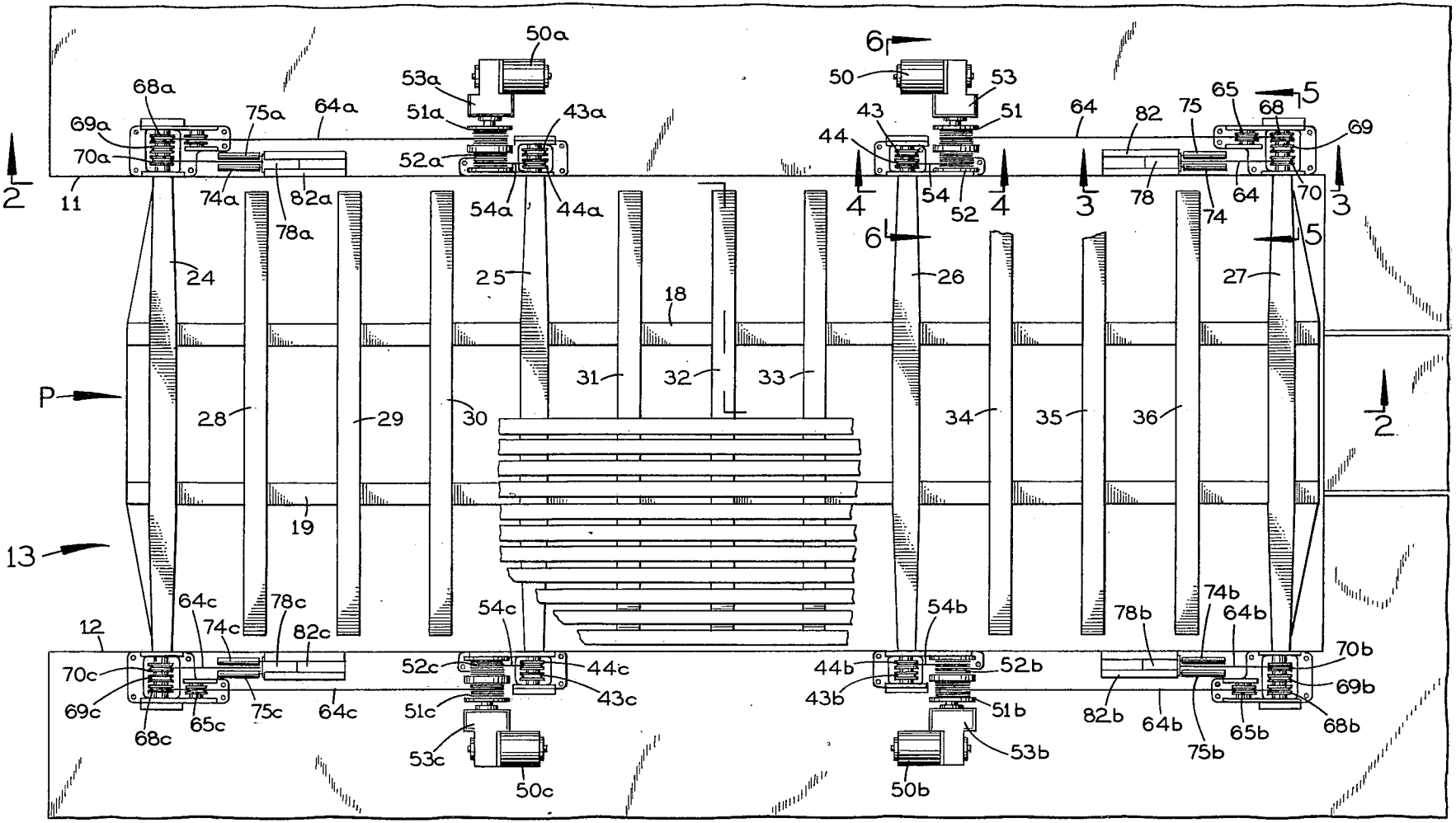
FIG. 1 is a top plan view of the present apparatus.

Referring to FIG. 1, the present apparatus is shown on a dock having opposite parallel sides 11 and 12 with a waterway 13 between them which at the left end in FIG. 1 opens into a body of water. Ships, boats or other structures can enter the waterway 13 at the open end of the dock before being raised out of the water by the present apparatus. Conversely, after being lowered into the waterway 13 by the present apparatus, they can move out into the body of water at the open end of the dock. The sides of the dock are shown as continuous and may be of any suitable rigid, massive construction such as huge concrete blocks set in place or rubble and poured concrete retained by metal sheet piling. Alternately, the lift support structure can be caissons sunk in position and capped with concrete or spaced concrete piers supported by marine pilings.

As shown in FIG. 2, the side 11 of the dock is formed with four vertical cutouts 14, 15, 16 and 17 at approximately even intervals along the length of the waterway 13 between the docks. Each of these cutouts is open at the top and extends down a substantial distance in the dock side. Each cutout is of uniform rectangular cross-section for its entire vertical depth, as shown for the cutout 16 in FIG. 6. The opposite dock side 12 is formed with four similar cutouts located directly opposite the cutouts 14–17 in dock side 11.

Figure 5:
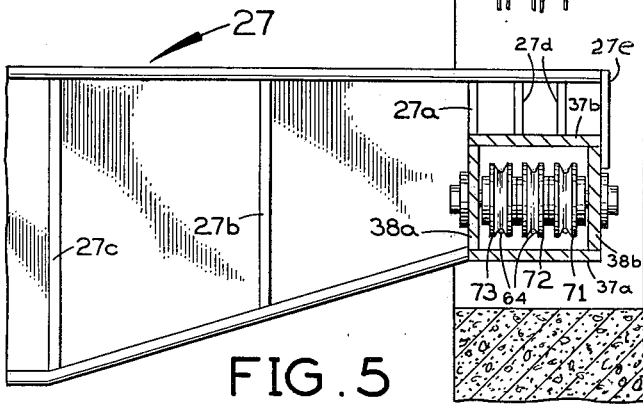
FIG. 5 is a fragmentary vertical cross-section taken along the line 5—5 in FIG. 1.
Figure 6:
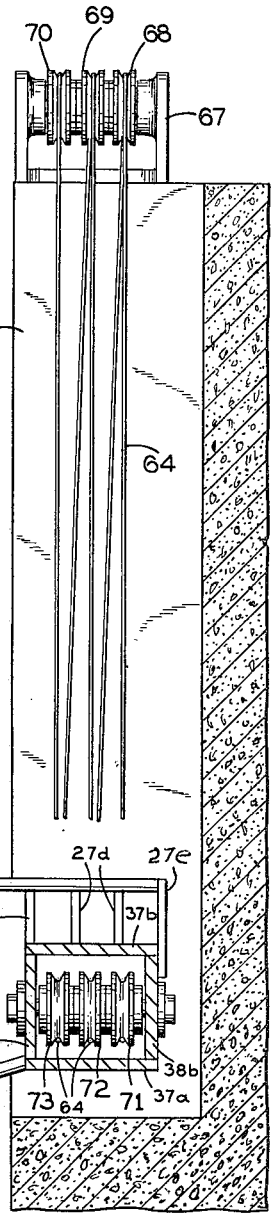
FIG. 6 is a fragmentary vertical cross-section taken along the line 6—6 in FIG. 1.
Figure 6:
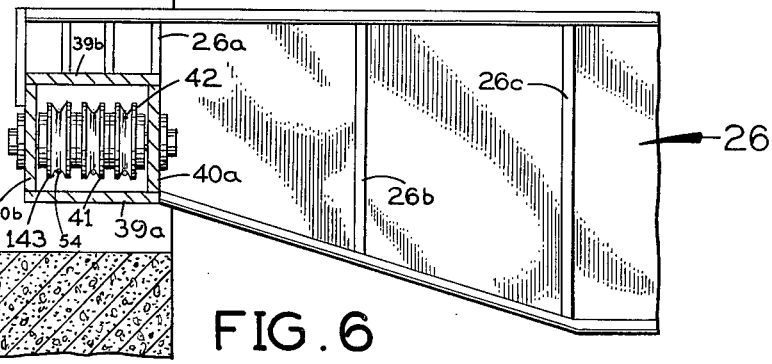

The apparatus has a horizontal lifting platform P (FIG. 1) located between the dock sides 11 and 12 and movable up and down to raise a ship, boat or other structure from the water or to lower the ship, boat or other structure into the water. The platform has a pair of horizontally disposed, laterally spaced, longitudinal beams 18 and 19 and a plurality of horizontally disposed, longitudinally spaced, transverse beams attached to the longitudinal beams. These transverse beams include four main beams 24, 25, 26 and 27, which are aligned with the respective cutouts 14, 15, 16 and 17 in the dock side 11 and with the corresponding cutouts in the opposite dock side 12. Each main transverse beam extends into the corresponding cutout in the dock wall, as shown in FIGS. 5 and 6 for the beams 27 and 26, respectively. In addition to the four main transverse beams 24–27, there are three shorter secondary transverse beams 28, 29 and 30 at evenly spaced intervals longitudinally of the platform between the main transverse beams 24 and 25, three shorter secondary transverse beams 31, 32 and 33 at similar intervals between the main transverse beams 25 and 26, and three shorter secondary transverse beams 34, 35 and 36 at similar intervals between the main transverse beams 26 and 27. Each of the secondary transverse beams has a substantial clearance at its opposite ends from the dock sides 11 and 12, respectively.

Each longitudinal beam 18 and 19 and each of the secondary transverse beams 28–36 preferably is an I beam. The secondary transverse beams overlie the longitudinal beams, as shown for the secondary transverse beams 34–36 and the longitudinal beam 18 in FIG. 2. The main transverse beams 24–27 also are I beams which are as deep vertically as the longitudinal beams and the secondary transverse beams combined, as shown in FIG. 2 for the main transverse beams 26 and 27 in relation to the longitudinal beam 18 and the secondary transverse beams 34, 35 and 36. The beams are welded or otherwise rigidly joined to each other in any desired manner.

The longitudinal beams 18 and 19 may be of one-piece construction or they may be composed of successive longitudinal segments which are hingedly or otherwise connected. For example, the longitudinal beams 18 and 19 could be divided into three segments each, with the main transverse beams 25 and 26 each being pivotally connected on both sides to the ends of their respective longitudinal beam segments.

At each end the bottom flange of each main transverse beam tapers upward, as shown in FIG. 5 for the beam 27. Vertical reinforcing plates 27*a*, 27*b* and 27*c* extend between the top and bottom flanges of the main beam 27 at its tapered end (FIG. 5), with the plate 27*a* being located just inside the corresponding cutout 17 in the dock side 11. The underside of the beam end has a rectangular shaped section cut from its vertical member or web. A sheave frame consisting of two vertical plates 38*a* and 38*b* and two horizontal plates 37*a* and 37*b* is welded into the aforementioned space provided. The lower horizontal plate 37*a* provides rigidity and strength to the frame and also holds the wire ropes in their sheave grooves should the cables become slack. Several vertical stiffeners 27*d* extend from the upper plate of the frame to the top flange of the beam. A beam end plate 27*e* extends from the top beam flange to below the upper frame plate. It will be apparent that with the cables reeved around the sheaves that the beam end would be prevented from dropping in the event of the collapse of the sheave frame, or the failure of a sheave or its shaft. The main transverse beam 27 has an identical construction at its opposite end, where its extension fits in the corresponding vertical cutout in the adjacent side 12 of the dock.

As shown in FIG. 6, the main transverse beam 26 has similar vertical reinforcing plates 26*a*, 26*b* and 26*c* extending between its top and bottom flanges at its tapered end. This beam has a lateral extension including a bottom wall 39*a*, a top wall 39*b* and upstanding end walls 40*a* and 40*b* which together with the reinforcing plate 26*a* define an extension which can move up and down in the cutout 16 in the dock side 11. The main transverse beam 26 has an identical construction at its opposite end, where it carries an extension that fits in the corresponding cutout in the adjacent side 12 of the dock.

The main transverse beam 25 is identical to beam 26, and the main transverse beam 24 is identical to beam 27. The identical beams 24 and 27 are located adjacent the opposite ends of the platform. The identical beams 25 and 26 are located between the end beams 24 and 27, toward the middle of the platform.

The motor-driven lifting arrangement which operates on the main transverse beams 26 and 27 at the dock side 11, will be described in detail. It is to be understood that three additional motor-driven lifting arrangements act respectively on:

(1) the beams 26 and 27 at the dock side 12;
(2) the main transverse beams 25 and 24 at the dock side 11; and
(3) the beams 25 and 24 at the dock side 12.

The elements of these latter three lifting arrangements are given the same reference numerals, with "a", "b", and "c" suffixes added, as the reference numerals for the lifting arrangement which operates on beams 26 and 27 at the dock side 11.

Referring to FIG. 6, the end extension 26*a*, 39, 40 on the main transverse beam 26 rotatably supports a first set of lower pulleys 41, 42 and 143 which are positioned end-to-end inside this extension. At the top of the dock side 11 a first set of upper pulleys 43 and 44 is rotatably supported by a mounting bracket B which straddles the open upper end of the cutout 16 in this side of the dock. The upper pulleys 43 and 44 are substantially in vertical alignment with the lower pulleys 41, 42 and 143. An electric motor 50 drives a pair of drums 51 and 52 (FIG. 1) through a speed reducing mechanism 53 of known design, such as a gear reduction. As shown in FIG. 1, the drums 51 and 52 are positioned end-to-end and they rotate on a common horizontal axis which extends perpendicular to the length of the platform P, as do the rotational axes of the upper pulleys 43 and 44 and the lower pulleys 41, 42 and 143.

Figure 4:
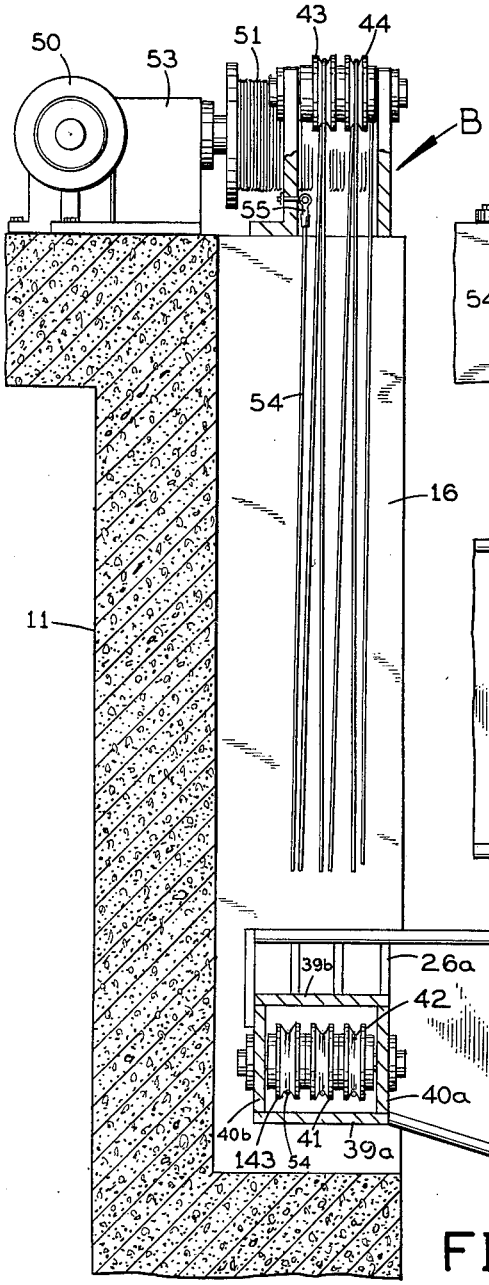
FIG. 4 is a fragmentary vertical longitudinal section taken along the line 4—4 in FIG. 1.
Figure 4:
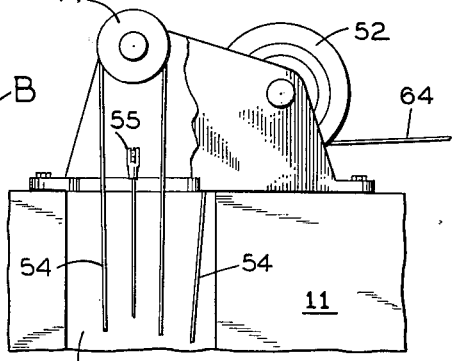

A first flexible cable 54 (FIG. 4) of steel or other suitable high tensile strength material is attached at one end to the drum 52. From this drum it extends substantially vertically down to the lower pulley 42 (FIG. 10), passing beneath pulley 42 and then extending up to the upper pulley 44, passing over the top of pulley 44 and then down to the lower pulley 41, passing beneath pulley 41 and then extending up to upper pulley 43, then down around lower pulley 143 and up to a welded attachment at 55 to the support bracket B for the upper pulleys 43 and 44. This path of the cable 54 is shown schematically in FIG. 10, from which it will be apparent that rotation of the drum 52 in a direction causing the cable to be wound up on the drum will produce a lifting force on the lower pulleys 41, 42 and 143. This lifting force is, of course, applied to the adjacent end of the main transverse beam 26, which carries these lower pulleys.

The other drum 51 of the pair driven by motor 50 carries a similar cable 64, which has one end attached to this drum. Cable 64 extends from drum 51 longitudinally of the platform P toward the end where the main transverse beam 27 is located. Near the upper end of the cutout 17 in the dock side 11, cable 64 passes over the top of a guide pulley 65 (FIG. 3) and then down from this pulley into the dock side cutout 17. Pulley 65 is supported for rotation by a bracket 66 which extends up from the dock at this side.

Another bracket 67 straddles the upper end of the cutout 17 and rotatably supports a second set of upper pulleys 68, 69 and 70 (FIG. 5). The end extension 27*a*, 37 and 38 of the main transverse beam 27, which is located in the cutout 17, rotatably supports a second set of lower pulleys 71, 72 and 73. As shown, pulleys 68–70 of the second set of upper pulleys are coaxially positioned end-to-end. This is also true of the pulleys 71–73 of the second set of lower pulleys.

Figure 3:
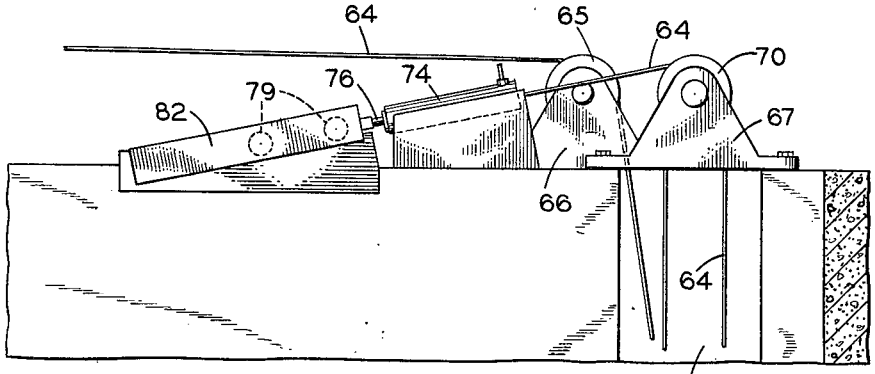
FIG. 3 is a fragmentary vertical longitudinal section taken along the line 3—3 in FIG. 1.

As shown schematically in FIG. 9, from the guide pulley 65 the cable 64 passes down through the cutout 17 in the dock side to the lower pulley 71, passing beneath pulley 71 and then extending up to the upper pulley 68, passing over the top of pulley 68 and then down to the next lower pulley 72, passing beneath pulley 72 and then extending up to the next upper pulley 69, passing over the top of pulley 69 and then down to the next lower pulley 73, passing beneath pulley 73, and then extending up to the next upper pulley 70, passing up across the top of pulley 70 between a pair of fluid-operated cylinders 74 and 75 (FIG. 7). These cylinders may be either controlled by hydraulic or pneumatic means. The cylinders operate respective pistons attached to piston rods 76 and 77 whose outer ends are connected to a slide plate 78. The end of cable 64 is attached to this slide plate. As shown in FIGS. 7 and 8, the slide plate 78 is mounted on rollers 79 which are movable along guide tracks 80 and 81 on opposite sides of the slide plate. As shown in FIG. 3, these guide tracks are provided by a guide member 82 which is inclined downward away from the dock side cutout 17. After the motors 50, 50*a*, 50*b* and 50*c* have been operated to raise the platform to substantially the desired height, the cylinders 74 and 75 may be operated to provide a fine adjustment of the vertical position of the platform P in relation to the dock at the closed end of the waterway, so that the boat or other structure on the platform can be moved as easily as possible from the platform to shore. This fine adjustment is achieved simply by operating these cylinders to move the slide 78 in one direction or the other, depending upon whether the end of the platform needs to be raised or lowered, and without requiring use of the electric motors 50, 50*a*, 50*b* and 50*c* which perform the primary lifting and lowering operations.

If desired, the cylinders may be replaced by self-locking electro-mechanical actuators, such as geared screw-jacks driven by electric motors or motor-driven rack and gear units, which are mechanically coupled to operate synchronously.

It will be understood that an identical motor driven lifting mechanism is provided on the opposite side 12 of the dock at the same end of the platform as the lifting mechanism operated by motor 50, as already described in detail. Corresponding elements of this lifting mechanism are given the same reference numerals, with a "b" suffix added, in FIG. 1 as the elements of the lifting mechanism already described and shown in detail in FIGS. 2–10. The lifting mechanism on the dock side 12 at this end of the platform includes a first set of lower pulleys (not shown) in an end extension on the main transverse beam 26, a first set of upper pulleys 43*b* and 44*b* (FIG. 1), drums 51*b* and 52*b* driven by motor 50*b* through a gear reduction 53*b*, and a cable 54*b* acting between the motor-driven drum 52*b* and the first sets of upper and lower pulleys in the manner already disclosed. This lifting mechanism also includes a second set of lower pulleys (not shown) in an end extension on the main transverse beam 27, a second set of upper pulleys 68*b*, 69*b* and 70*b*, a guide pulley 65*b*, and a cable 64*b* extending from the motor-driven drum 51*b* to the second sets of lower and upper pulleys and from there to the slide 78*b* operated by cylinders 74*b* and 75*b*.

At the opposite end of the platform, the motor-driven lifting arrangements are mirror images of the ones at the inner end of the platform. The elements of the lifting arrangement on the dock side 11 which raises and lowers the adjacent end of the main transverse beams 25 and 24 are given the same reference numerals, with an "a" suffix added, as those already described. The elements of the lifting arrangement on the opposite side 12 of the dock for raising and lowering the adjacent end of beams 25 and 24 are given the same reference numerals, with a "c" suffix added. The operation of these lifting arrangements is the same as already described in detail for the first lifting arrangement and therefore need not be repeated in detail.

The four electric motors 50, 50*a*, 50*b* and 50*c* are of the synchronous type and are controlled by a motor control circuit of known design so that they operate simultaneously. Each motor provides the lifting force for one end of each of two main transverse beams, so that the total number of motors required is equal to the number of main transverse beams in the platform, instead of twice as many motors as the number of main transverse beams in the platform, as previously. This reduction in the number of motors required makes it possible to use a simpler motor control circuit. The connections of the motor-driven cables to eight lift points on the platform P enhances the stability, reliability and safety of the system.

I claim:

1. In an apparatus for lifting or lowering a water-borne structure, said apparatus having:

a dock having spaced apart, opposite sides and an open end between said sides through which the water-borne structure can enter and leave;

a support platform extending between said opposite sides and movable vertically between a lowered position below water and raised position above water, said support platform comprising a plurality of longitudinal horizontal beams spaced apart laterally from each other and each extending generally parallel to said opposite sides of the dock, and a plurality of transverse horizontal beams extending substantially perpendicular to said longitudinal beams and rigidly attached thereof, said transverse beams including main beams at intervals along the length of said longitudinal beams and secondary beams at shorter intervals between successive main beams;

the improvement which comprises:

on each side of the dock, a single drive motor for each pair of main transverse beams in succession along the length of said platform, said motor being mounted on the corresponding side of the dock;

a pair of intercoupled drums driven by each said motor;

a respective first set of lower pulleys mounted on one of said pair of main transverse beams at the end thereof adjacent said corresponding side of the dock;

a respective first set of upper pulleys mounted on said corresponding side of the dock;

a respective first flexible cable fastened at one end to one of said drums of the corresponding pair and fastened at its opposite end to said corresponding side of the dock, said cable operatively engaging the pulleys of the corresponding first set of upper pulleys and the pulleys of the corresponding first set of lower pulleys and extending between them to impart an upward force to said one main transverse beam upon rotation of said corresponding one drum in one direction;

a respective second set of lower pulleys mounted on the other main transverse beam of said pair at the end of said beam adjacent said corresponding side of the dock;

a respective second set of upper pulleys mounted on said corresponding side of the dock;

and a respective second flexible cable fastened at one end to the other of said drums of the corresponding pair and operatively connected at its opposite end to said corresponding side of the dock, said second cable operatively engaging the pulleys of the corresponding second set of upper pulleys and the pulleys of the corresponding second set of lower pulleys and extending between them to impart an upward force to said other main transverse beam upon rotation of said other drum in one direction;

said first and second cables leading in divergent direction from said first and second drums respectively.

2. An apparatus according to claim 1, wherein each motor and the corresponding pair of drums are mounted on said corresponding side of the dock in close proximity to the corresponding one main transverse beam.

3. An apparatus according to claim 1, and further comprising adjusting means acting on said opposite end of each of said second cables for adjusting the latter's length between the corresponding second drum and the corresponding second set of lower pulleys, whereby to adjust the vertical position of the platform.

4. An apparatus according to claim 3, wherein each said means for adjusting comprises piston-and-cylinder means.

5. An apparatus according to claim 1, wherein the pulleys of each first set of upper pulleys are mounted at substantially the level of the corresponding first drum.

6. An apparatus according to claim 1, wherein the pulleys of each second set of upper pulleys are mounted at substantially the level of the corresponding second drum.

7. An apparatus according to claim 1, wherein the drums of each pair have a horizontal axis of rotation which extends at a substantial angle transverse to the length of said platform.

8. An apparatus according to claim 7, wherein said angle is substantially 90 degrees.

9. An apparatus according to claim 8, wherein each said motor and the corresponding pair of drums are mounted on said corresponding side of the dock in close proximity to the corresponding one main transverse beam.

10. An apparatus according to claim 9, wherein the pulleys of each first set of upper pulleys are mounted at substantially the level of the corresponding first drum, and the pulleys of each second set of upper pulleys are mounted at substantially the level of the corresponding second drum.

11. An apparatus according to claim 1, wherein:

said platform has four of said main transverse beams;

and there are four of said motors, two on each side of the dock, a pair of drums driven by each motor, a first cable and a second cable fastened to each pair of drums, a first set of said lower pulleys and a first set of said upper pulleys operated by each first cable, and a second set of said lower pulleys and a second set of said upper pulleys operated by each second cable.

12. An apparatus according to claim 11, wherein said four motors and the corresponding drums are located respectively adjacent the two main transverse beams of the platform which are closest to the longitudinal midpoint of the platform.

13. An apparatus according to claim 12, and further comprising:

four linear adjusters respectively acting on the opposite end of each of said second cables for adjusting the length thereof between the corresponding second drum and the corresponding second set of lower pulleys, whereby to adjust the vertical position of the platform.

14. An apparatus according the claim 13, wherein each of said linear adjusters comprises:

a slide mounted for movement longitudinally of the platform and operatively connected to the corresponding second cable;

and fluid-operated piston-and-cylinder means operatively coupled to said slide to position it longitudinally of the platform.

15. An apparatus according to claim 1 wherein:

said drums are located between said first and second sets of pulleys;

said first cable leads substantially vertically downward from said first drum;

and said second cable leads substantially horizontally from said second drum.

16. In an apparatus for lifting or lowering a water-borne structure, said apparatus having:

a dock having spaced apart, opposite sides and an open end between said sides through which the water-borne structure can enter and leave;

a support platform extending between said opposite sides and movable vertically between a lowered position below water and raised position above water, said support platform comprising a plurality of longitudinal horizontal beams spaced apart laterally from each other and each extending generally parallel to said opposite sides of the dock, and a plurality of transverse horizontal beams extending substantially perpendicular to said longitudinal beams and rigidly attached thereto, said transverse beams including main beams at intervals along the length of said longitudinal beams and secondary beams at shorter intervals between successive main beams;

the improvement which comprises:

on each side of the dock, a single drive motor for each pair of main transverse beams in succession along the length of said platform, said motor being mounted on the corresponding side of the dock;

a pair of intercoupled drums driven by each said motor;

a respective first set of lower pulleys mounted on one of said pair of main transverse beams at the end thereof adjacent said corresponding side of the dock;

a respective first set of upper pulleys mounted on said corresponding side of the dock;

a respective first flexible cable fastened at one end to one of said drums of the corresponding pair and fastened at its opposite end to said corresponding side of the dock, said cable operatively engaging the pulleys of the corresponding first set of upper pulleys and the pulleys of the corresponding first set of lower pulleys and extending between them to impart an upward force to said one main transverse beam upon rotation of said corresponding one drum in one direction;

a respective second set of lower pulleys mounted on the other main transverse beam of said pair at the end of said beam adjacent said corresponding side of the dock;

a respective second set of upper pulleys mounted on said corresponding side of the dock;

and a respective second flexible cable fastened at one end to the other of said drums of the corresponding pair and operatively connected at its opposite end to said corresponding side of the dock, said second cable operatively engaging the pulleys of the corresponding second set of upper pulleys and the pulleys of the corresponding second set of lower pulleys and extending between them to impart an upward force to said other main transverse beam upon rotation of said other drum in one direction;

and adjusting means acting on said opposite end of each of said second cables for adjusting the latter's length between the corresponding second set of upper pulleys and the corresponding second set of lower pulleys, whereby to adjust the vertical position of the platform.

17. In an apparatus for lifting or lowering a water-borne structure, said apparatus having:

a dock having spaced apart, opposite sides and an open end between said sides through which the water-borne structure can enter and leave;

a support platform extending between said opposite sides and movable vertically between a lowered position below water and raised position above water, said support platform comprising a plurality of longitudinal horizontal beams spaced apart laterally from each other and each extending generally parallel to said opposite sides of the dock, and a plurality of transverse horizontal beams extending substantially perpendicular to said longitudinal beams and rigidly attached thereto, said transverse beams including main beams at intervals along the length of said longitudinal beams and secondary beams at shorter intervals between successive main beams;

a drive motor mounted on one side of the dock;

a rotary drum on said one side of the dock driven by said motor;

a set of lower pulleys mounted on one of said main transverse beams at the end thereof adjacent said one side of the dock;

a set of upper pulleys mounted on said one side of the dock above said set of lower pulleys;

and a flexible cable fastened at one end to said drum and operatively engaging said upper and lower pulleys and extending between them to impart an upward force to said one main transverse beam upon rotation of said drum in one direction;

the improvement which comprises:

fluid-operated adjusting means acting on said opposite end of said cable for adjusting the latter's length between said set of upper pulleys and said set of lower pulleys, whereby to adjust the vertical position of the platform at said main transverse beam while the platform is under load.

18. An apparatus according to claim 17, wherein said fluid-operated adjusting means comprises:

a guide member mounted on said one side of the dock;

a slide plate attached to said opposite end of said cable;

rollers mounting said slide plate on said guide member;

and fluid-operated cylinder-and-piston means operatively coupled to said slide plate for adjusting the latter's position along said guide member toward and away from said set of upper pulleys.

19. An apparatus according to claim 18, wherein:

said guide member is inclined downward away from said set of upper pulleys;

and said cylinder-and-piston means comprises two cylinder-and-piston units mounted respectively on opposite sides of said cable at the latter's attachment to said slide plate.

* * * * *